US009080439B2

(12) United States Patent
O'Malley et al.

(10) Patent No.: US 9,080,439 B2
(45) Date of Patent: Jul. 14, 2015

(54) DISINTEGRABLE DEFORMATION TOOL

(75) Inventors: Edward J. O'Malley, Houston, TX (US); Graeme M. Kelbie, Cypress, TX (US); YingQing Xu, Tomball, TX (US); James G. King, Kingwood, TX (US); Jimmie J. Holland, Harrah, OK (US)

(73) Assignee: Baker Hughes Incorporated, Houston, TX (US)

( * ) Notice: Subject to any disclaimer, the term of this patent is extended or adjusted under 35 U.S.C. 154(b) by 507 days.

(21) Appl. No.: 13/549,659

(22) Filed: Jul. 16, 2012

(65) Prior Publication Data

US 2014/0014339 A1 Jan. 16, 2014

(51) Int. Cl.

| | |
|---|---|
| ***E21B 33/12*** | (2006.01) |
| ***E21B 29/00*** | (2006.01) |
| ***E21B 43/26*** | (2006.01) |
| ***E21B 33/13*** | (2006.01) |
| ***C22C 1/04*** | (2006.01) |

(52) U.S. Cl.

CPC ..... *E21B 43/261* (2013.01); *C22C 1/0408* (2013.01); *E21B 33/13* (2013.01)

(58) Field of Classification Search

CPC ... E21B 43/103; E21B 43/105; E21B 43/108; E21B 43/10; E21B 34/14; E21B 34/063; E21B 33/16; E21B 23/04; E21B 33/127; E21B 33/12; E21B 33/134; E21B 23/00; E21B 23/06; E21B 33/13; E21B 43/261

USPC ..... 166/192, 193, 195

See application file for complete search history.

(56) References Cited

U.S. PATENT DOCUMENTS

| | | | | |
|---|---|---|---|---|
| 7,373,990 | B2 * | 5/2008 | Harrall et al. | 166/380 |
| 7,503,392 | B2 | 3/2009 | King | |
| 7,603,758 | B2 * | 10/2009 | Cook et al. | 29/507 |
| 7,665,537 | B2 | 2/2010 | Patel | |
| 8,267,177 | B1 * | 9/2012 | Vogel et al. | 166/317 |
| 8,403,037 | B2 * | 3/2013 | Agrawal et al. | 166/193 |
| 8,573,295 | B2 * | 11/2013 | Johnson et al. | 166/193 |
| 8,776,884 | B2 * | 7/2014 | Xu et al. | 166/308.1 |
| 2004/0244968 | A1 * | 12/2004 | Cook et al. | 166/242.6 |
| 2005/0139359 | A1 * | 6/2005 | Maurer et al. | 166/380 |
| 2011/0132619 | A1 * | 6/2011 | Agrawal et al. | 166/376 |

(Continued)

FOREIGN PATENT DOCUMENTS

EP 2251525 A1 11/2010

OTHER PUBLICATIONS

Halliburton, [online]; [retrieved from on Sep. 24, 2012]; retrieved from the Internet http://www.halliburton.com/public/tttcp/contents/Data_Sheets/web/H/H06160.pdf, "Fas Drill® Bridge Plug," 2p.

(Continued)

*Primary Examiner* — Kenneth L Thompson
*Assistant Examiner* — Michael Wills, III
(74) *Attorney, Agent, or Firm* — Cantor Colburn LLP

(57) ABSTRACT

A deformation system, including a deformable member and a tool operatively arranged to deform the member due to actuation of the tool from a first set of dimensions at which the deformable member is positionable with respect to a structure to a second set of dimensions at which the deformable member engages with the structure. The tool at least partially comprises a disintegrable material responsive to a selected fluid. A method of operating a deformation system is also included.

23 Claims, 7 Drawing Sheets

(56) References Cited

U.S. PATENT DOCUMENTS

| | | | | |
|---|---|---|---|---|
| 2011/0132621 | A1* | 6/2011 | Agrawal et al. | 166/376 |
| 2012/0024109 | A1 | 2/2012 | Xu | |
| 2012/0118583 | A1* | 5/2012 | Johnson et al. | 166/376 |
| 2012/0168163 | A1 | 7/2012 | Bertoja | |

OTHER PUBLICATIONS

Notification of Transmittal of the International Search Report and the Written Opinion of the International Searching Authority, or the Declaration; PCT/US2013/045870; Aug. 28, 2013.

* cited by examiner

DISINTEGRABLE DEFORMATION TOOL

BACKGROUND

So-called "plug and perf" operations are well known in the downhole drilling and completions industry. Generally in this type of operation, a first zone toward a downhole end of a borehole is perforated, fractured, and then isolated from the adjacent up-hole zone with a plug assembly, e.g., a composite bridge plug or the like. In turn, each zone located sequentially in the up-hole direction is perforated, fractured, and then isolated with a plug assembly. Before production begins, the plug assemblies must be removed. This is achieved by either milling out or retrieving the plug assemblies, both of which operations, while suitable for their intended purposes, require potentially time consuming and costly intervention. In view hereof, the industry well receives advances and alternatives in plugging technology, particularly to technologies that reduce the need for intervention.

SUMMARY

A deformation system, including a deformable member; and a tool operatively arranged to deform the member due to actuation of the tool from a first set of dimensions at which the deformable member is positionable with respect to a structure to a second set of dimensions at which the deformable member engages with the structure, wherein the tool at least partially comprises a disintegrable material responsive to a selected fluid.

A method of operating a deformation system, including actuating a tool at least partially formed from a disintegrable material; deforming a deformable member with the tool; and disintegrating the tool upon exposure to a selected fluid.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
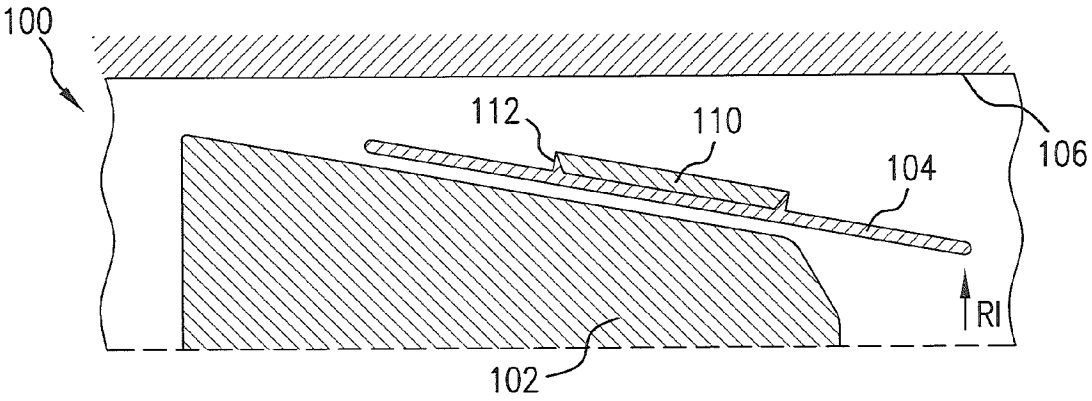
FIG. 1 is a cross-sectional view of a system including a disintegrable tool engaging a deformable member.

Referring now to FIG. 1, a downhole expansion system 100 is shown having a deformation tool 102 partially engaged with a deformable member 104 for deforming the member 104 from a first set of dimensions to a second set of dimension. Namely, the member 104 in the illustrated embodiment is generally annular or ring shaped, and is radially enlarged by the tool 102 from a first set of dimensions, e.g., a radius R1 shown in FIG. 1, to a second set of dimensions, e.g., a radius R2 shown in FIG. 3. While radial expansion of tubulars is typical in the downhole drilling and completions industry, it is to be appreciated that the member 104 could alternatively take other shapes, e.g., non-annular shapes, and be deformed in other directions, e.g., axially, and that the Figures illustrate one example only. Furthermore, any mechanical deformation process, e.g., swaging, drawing, bending, compressing, stretching, etc., could be used to alter any desired dimension of the member 104 by actuation of the tool 102. Accordingly, the tool 102 could be any suitable setting tool or take any suitable form, e.g., a wedge, swage, shoulder, cone, ramp, mandrel, etc., orientated in any direction, i.e., corresponding to the desired direction of deformation of the member 104.

Figure 2:
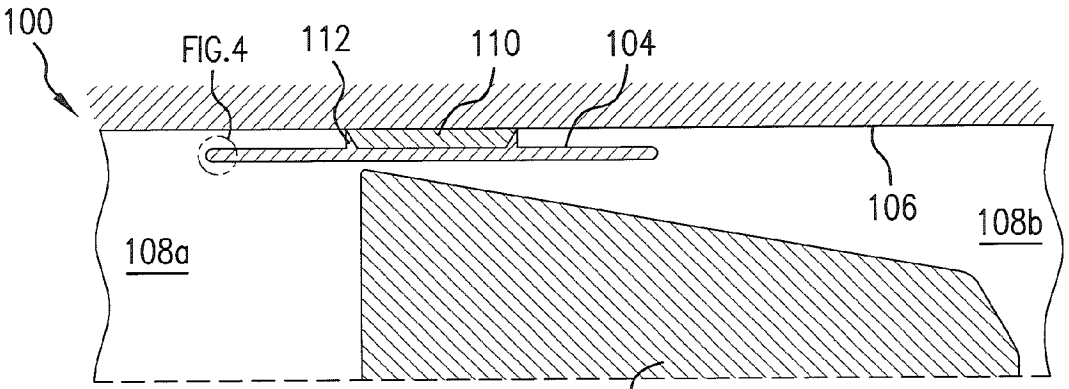
FIG. 2 is a cross-sectional view of the system of FIG. 1 with the member deformed by the tool against an outer structure.

In order to deform the deformable member 104, the tool 102 can be actuated by an actuator or actuation configuration that is powered hydraulically, mechanically, electrically, magnetically, etc. In FIGS. 1 and 2, the tool 102 is illustrated as a plug or dart that is droppable and/or pumpable downhole through an outer structure 106, e.g., a borehole, casing, tubular string, etc. Of course, the tool 102 could be disposed on or with a string, for example as described in U.S. Pat. No. 6,352,112 (Mills), which Patent is hereby incorporated by reference in its entirety. Referring back to the drawings, once the tool 102 engages the member 104, hydraulic pressure (or some other actuation force) against the tool 102, e.g. as a result of pumping fluid through the structure 106, forces the tool 102 progressively through the member 104 to deform the member 104.

After deforming the member 104, the tool 102 may have no further function and therefore be desired to be removed from the structure 106 so as not to block the passage through the structure 106, interfere with subsequent operations (e.g., production), etc. Some form of intervention would be necessary to remove the tool 102, e.g., a retrieval or fishing operation, milling, etc. Furthermore, retrieval may be complicated if the deformed member elastically deforms back to a set of dimensions smaller than that of the deformation tool, resulting in increased friction between the deformation tool and the deformed member, or, in the event that the tool passes entirely through the deformed member, dimensional overlap between the tool and the deformed member. Intervention can be time consuming, and therefore costly. Advantageously, the deformation tools according to the current invention as described herein, e.g., the tool 102, are made at least partially from a disintegrable material that is responsive to a selected fluid, thereby avoiding the need for intervention to remove the tool 102. That is, as used herein, "disintegrable" refers to a material or component that is consumable, corrodible, degradable, dissolvable, weakenable, or otherwise removable. It is to be understood that use herein of the term "disintegrate," or any of its forms (e.g., "disintegration", etc.), incorporates the stated meaning. The selected fluid could be a fluid present within the structure 106, e.g., a downhole fluid such as brine, water, oil, etc., or could be a fluid that is delivered or pumped downhole specifically for the purpose of disintegrating the tool 102, e.g., solvents, acids, etc.

Figure 3:
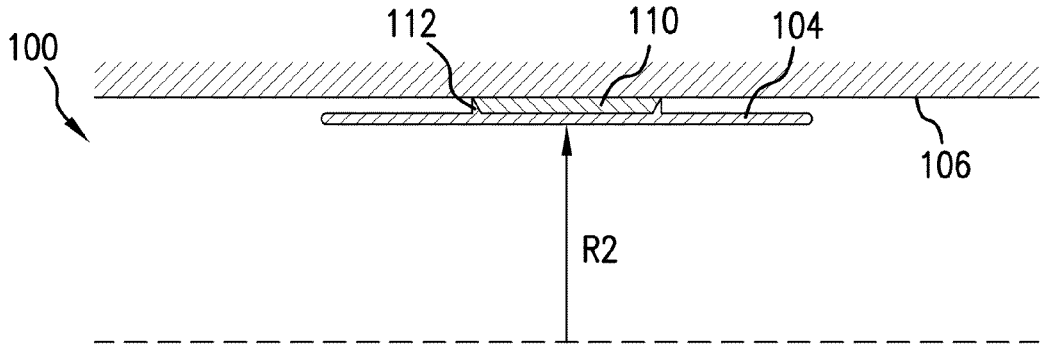
FIG. 3 is a cross-sectional view of the system of FIG. 1 after the tool has been disintegrated.

In particularly advantageous embodiments, the tool 102 is formed from a metal composite that includes a metal matrix disposed in a cellular nanomatrix, described in more detail below, which enables tailorability of various properties of the tool 102, such as disintegration rate, compressive strength, hardness, etc. That is, while disintegrable materials such as Zn, Al, Mg, etc. are incorporated in the below discussed metal composites, the particular structure of the composites enables the tool 102 to be used successfully in a variety of scenarios in which the metals in their natural forms would have failed. In this way, for example, the tool 102 can be tailored have a disintegration rate that strikes a balance between enabling the tool 102 to be present sufficiently long to complete the deformation process, while not permitting the tool 102 to linger in the structure 106 for an undesirably long period of time. Furthermore, the physical or mechanical characteristics of the tool 102 can be tailored to enable efficient deformation of the member 104. The system 100 is shown in FIG. 3 with the member 104 fully deformed against the structure 106 and the tool 102 disintegrated by a fluid present within the structure 106. In one embodiment, the member 104 is also made from a disintegrable material, such that both the member 104 and the tool 102 disintegrate after predetermined amount of time. Due to the tailorability of the materials discussed below, the member 104 can be made from a disintegrable material that has properties that differ from the tool 102, e.g., a lesser hardness and/or strength, slower disintegration rate, etc.

The member 104 in the illustrated embodiment optionally includes various features to enable the member 104 to sealingly engage the structure 106. That is, in the illustrated embodiment, the member 104 includes a sealing element 110 and at least one gripping element 112. The sealing element 110 is, for example, an elastomer, swellable material, foam material, or any other sealing element known or discovered in the art, or combinations thereof. The gripping elements 112 are, for example, slips, hardened grit (e.g., carbide), a textured or grooved surface, etc. In the illustrated embodiment, the gripping elements 112 are illustrated as teeth or protrusions extending radially from the member 104 toward the structure 106. In one embodiment, the gripping elements 112 are arranged to both anchor the member 104 to the structure 106 as well as provide a sealing function. For example, in one embodiment, the gripping elements 112 create a metal-to-metal seal with the structure 106.

DETAILED DESCRIPTION

Figure 4:
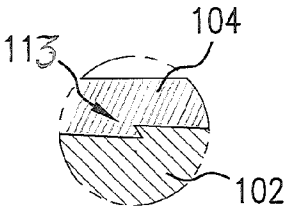
FIG. 4 is an enlarged view of a ratcheting or locking feature between the tool and the member.

By sealing the member 104 against the structure 106, the tool 102 and the member 104 are able to together isolate zones or areas within the structure 106 on opposite sides of the tool 102, the areas designated with the numerals 108*a* and 108*b*. Sealingly engaging and anchoring the member 104 with the structure 106 effectively results in the member 104 becoming a seat for the structure 106. Likewise, the engagement of the tool 102 with the member 104 effectively enables the tool 102 to behave as a plug for selectively blocking fluid flow through the structure 106. In order to assist in the maintenance of a seat/plug assembly, e.g., preventing the tool 102 and the member 104 from becoming prematurely disengaged, a locking or ratcheting feature 113 is shown in FIG. 4 for holding the tool 102 in an engaged relation with the member 104. The locking feature 113 is illustrated specifically as an engagement profile, e.g., a shoulder, notch, or protrusion that engages with a corresponding notch, groove, etc. It is to of course be appreciated that a similar locking profile or feature could be included at other locations, or a separate body lock ring or other component included for providing this functionality. For example, if the tool 102 is run in on a string, a locking feature could be included somewhere along the string for maintaining the tool 102 and the member 104 in engaged relation.

Due to the disintegrable nature of the tool 102 and/or the member 104, the aforementioned isolation in the structure 106 can be set so that it is only temporary. For example, in one embodiment, the system 100 is used in a plug and perf or fracturing operation in which the zone 108*b* is first opened to a surrounding formation, e.g., perforated, and pressure within the structure elevated to fracture the formation in the zone 108*b*. Thereafter in this scenario, the tool 102 is deployed to deform the member 104 and engage therewith in order to isolate the zones 108*a* and 18*b* from each other. The zone 18*a* can then be opened to the formation proximate the zone 108*a*, e.g., perforated, and then fractured, e.g., by pumping pressurized fluid into the structure 106. As discussed above, the tool 102 and member 104 are arranged in the illustrated embodiment, namely as shown in FIG. 2, so that after deformation they essentially resemble a seat and plug assembly for the structure 106. It is to be appreciated that this avoids the need for a retrievable or millable bridge plug or the like. The plug and perf or fracturing process can be repeated with any number of additional instances of the system 100 throughout the length of the structure 106 to enable the fracturing of any number of desired zones. Since only the most up-hole of the tools 102 and members 104 need to be intact for enabling the isolation necessary to fracture subsequent up-hole zones, the tools 102 (and/or the members 104) can be tailored to disintegrate any time after they have been used for fracturing. In this way, downhole lengths of the structure 106 are opened while subsequent fracturing operations commence, thereby quickly opening the entire length of the structure 106, e.g. for production, shortly after fracturing is completed, unlike prior art plugging devices that require subsequent intervention, e.g., milling, retrieval, etc.

Figure 5:
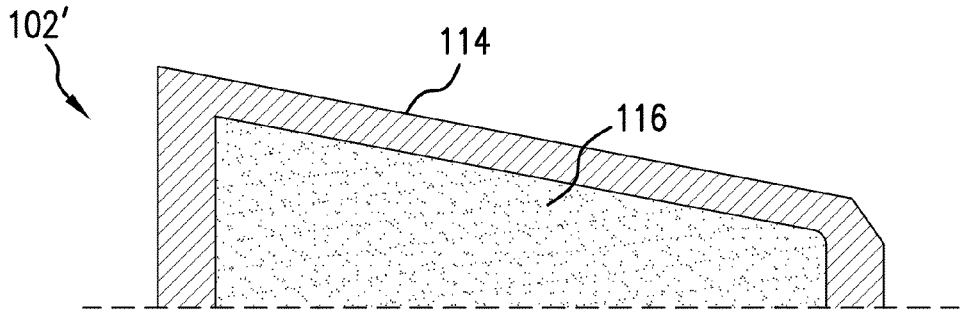
FIG. 5 is a cross-sectional view of a system according to another embodiment disclosed herein.

FIG. 5 illustrates a tool 102' according to another embodiment disclosed herein. Specifically, the tool 102' includes a shell 114 disposed about a core 116. By selecting different materials for the shell 114 and the core 116, the efficiency of the system 10 can be further increased. For example, the shell 114 could be made from a first material having greater mechanical properties, a slower disintegration rate, etc., than a second material forming the core 116. For example, greater strength and/or hardness of the shell 114 will facilitating deformation by the tool 102', while a relatively slower disintegration rate will enable the tool 102' to be present for a sufficiently long amount of time (e.g., long enough to enable a fracturing operation), but will thereafter rapidly disintegrate. Furthermore, if the strength and/or hardness of the shell 114 are set sufficiently, relatively weak materials that would otherwise be unsuitable for a deformation operation can be used for the core 116. In one embodiment, the core 116 is formed from calcium carbonate, a salt, or other rapidly soluble, dissolvable, or disintegrable material. In another embodiment, both the shell 114 and the core 116 are formed from metal composites according to the below discussion, but tailored to provide different characteristics.

Figure 10:
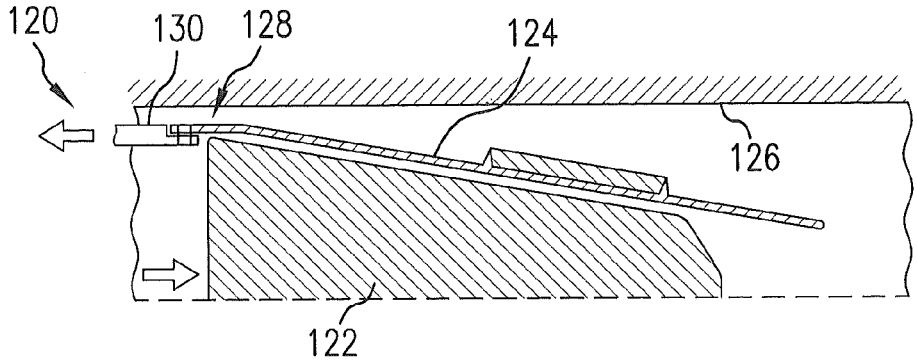
FIG. 10 is a cross-sectional view of a system according to another embodiment disclosed herein.

It is to be appreciated that in order to expand the member 104, an anchor or support device may be included for enabling relative movement between the tool 102 and the member 104, e.g., to prevent movement of the member 104 while the tool 102 is forcibly actuated therethrough or to pull the member 104 in a direction opposite to the tool 102. FIG. 10 depicts a system 120 that includes a tool 122 resembling the tool 102 and a deformable member 124. The member 124 generally resembles the member 104 (e.g., including a suitable seal and/or gripping elements, engagable with the member 122 to isolate a structure 126, etc.) with the exception that the member 124 is secured via a releasable connection 128 to a support 130. The support 130 is at least partially movable relative to the tool 122 (e.g., stationary or able to be pulled in a direction opposite to the actuation direction of the tool 122) so that the member 124 is stabilized while being deformed. In the illustrated embodiment, the releasable connection 128 includes one or more shear screws 132, which shear in order to release the member 124 from the support 130 at a pressure greater than that required to deform the member 124 with the tool 122. It is to be appreciated that other release members could be used, such as collet fingers, a notched or weakened connection point, etc.

Figure 11:
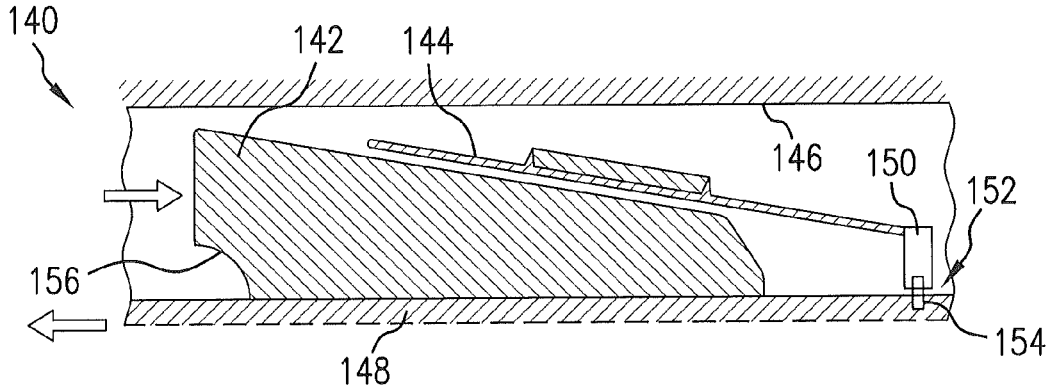
FIG. 11 is a cross-sectional view of a system according to yet another embodiment disclosed herein in an initial configuration.
Figure 12:
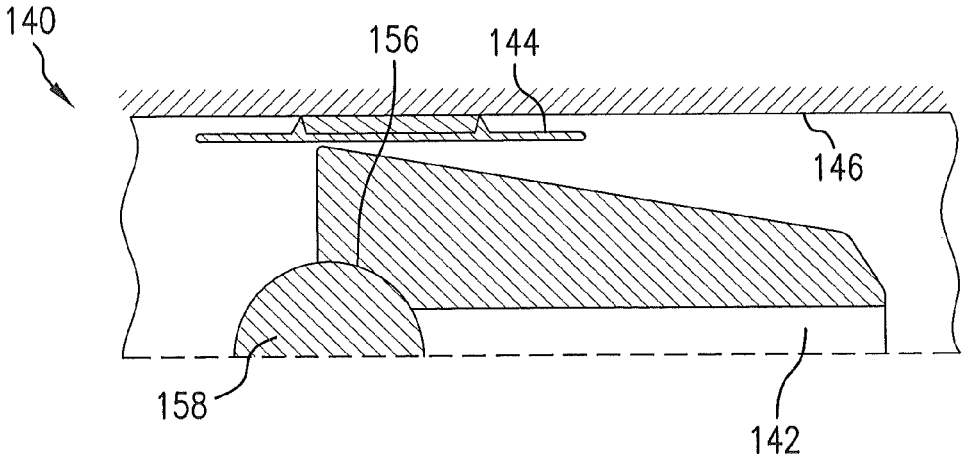
FIG. 12 is a cross-sectional view of the system of FIG. 11 in a set configuration.

A system 140 according to another embodiment is shown in FIGS. 11 and 12. Similar to the previously discussed embodiments, the system 140 includes a tool 142 for deforming a deformable member 144. The deformable member 144 resembles the member 104 discussed above, e.g., including suitable seal and gripping elements. The tool 142, although similarly arranged as a cone, wedge, swage, etc. for deforming the member 144 against a structure 146, differs from the tools 102 and 122 in that the tool 142 is arranged so that a rod, pipe, or other member 148 can be inserted therethrough. The rod 148 includes a flange or radially extending support member(s) 150 for axially supporting the member 144, thereby enabling relative movement between the tool 142 and the member 144 as the member 144 is deformed by the tool 142. The flange or radial support member(s) 150 is secured via a releasable connection 152 to the rod 148, which in the illustrated embodiment takes the form of one or more shear screws 154. Of course, other release members as noted above could be included. In this way, after sufficiently deforming the member 144, the tool 142 contacts the support member 150 and enables the rod 148 to be released from the support 150 (e.g. by shearing the screws 154) so that the rod 148 can be pulled out through the tool 142. In order to provide the aforementioned isolation within the structure 146, the tool 142 may be provided with a seat portion 156 for receiving a plug 158 that can be dropped or released after the rod 148 is removed.

Materials appropriate for the purpose of degradable protective layers as described herein are lightweight, high-strength metallic materials. Examples of suitable materials and their methods of manufacture are given in United States Patent Publication No. 2011/0135953 (Xu, et al.), which Patent Publication is hereby incorporated by reference in its entirety. These lightweight, high-strength and selectably and controllably degradable materials include fully-dense, sintered powder compacts formed from coated powder materials that include various lightweight particle cores and core materials having various single layer and multilayer nanoscale coatings. These powder compacts are made from coated metallic powders that include various electrochemically-active (e.g., having relatively higher standard oxidation potentials) lightweight, high-strength particle cores and core materials, such as electrochemically active metals, that are dispersed within a cellular nanomatrix formed from the various nanoscale metallic coating layers of metallic coating materials, and are particularly useful in borehole applications. Suitable core materials include electrochemically active metals having a standard oxidation potential greater than or equal to that of Zn, including as Mg, Al, Mn or Zn or alloys or combinations thereof. For example, tertiary Mg—Al—X alloys may include, by weight, up to about 85% Mg, up to about 15% Al and up to about 5% X, where X is another material. The core material may also include a rare earth element such as Sc, Y, La, Ce, Pr, Nd or Er, or a combination of rare earth elements. In other embodiments, the materials could include other metals having a standard oxidation potential less than that of Zn. Also, suitable non-metallic materials include ceramics, glasses (e.g., hollow glass microspheres), carbon, or a combination thereof. In one embodiment, the material has a substantially uniform average thickness between dispersed particles of about 50 nm to about 5000 nm. In one embodiment, the coating layers are formed from Al, Ni, W or $Al_2O_3$, or combinations thereof. In one embodiment, the coating is a multi-layer coating, for example, comprising a first Al layer, a $Al_2O_3$ layer, and a second Al layer. In some embodiments, the coating may have a thickness of about 25 nm to about 2500 nm.

These powder compacts provide a unique and advantageous combination of mechanical strength properties, such as compression and shear strength, low density and selectable and controllable corrosion properties, particularly rapid and controlled dissolution in various borehole fluids. The fluids may include any number of ionic fluids or highly polar fluids, such as those that contain various chlorides. Examples include fluids comprising potassium chloride (KCl), hydrochloric acid (HCl), calcium chloride ($CaCl_2$), calcium bromide ($CaBr_2$) or zinc bromide ($ZnBr_2$). For example, the particle core and coating layers of these powders may be selected to provide sintered powder compacts suitable for use as high strength engineered materials having a compressive strength and shear strength comparable to various other engineered materials, including carbon, stainless and alloy steels, but which also have a low density comparable to various polymers, elastomers, low-density porous ceramics and composite materials.

In some embodiments, the disintegrable material is a metal composite that includes a metal matrix disposed in a cellular nanomatrix and a disintegration agent. In an embodiment, the disintegration agent is disposed in the metal matrix. In another embodiment, the disintegration agent is disposed external to the metal matrix. In yet another embodiment, the disintegration agent is disposed in the metal matrix as well as external to the metal matrix. The metal composite also includes the cellular nanomatrix that comprises a metallic nanomatrix material. The disintegration agent can be disposed in the cellular nanomatrix among the metallic nanomatrix material. An exemplary metal composite and method used to make the metal composite are disclosed in U.S. patent application Ser. Nos. 12/633,682, 12/633,688, 13/220,832, 13/220,822, and 13/358,307, the disclosure of each of which patent application is incorporated herein by reference in its entirety.

Figure 6:
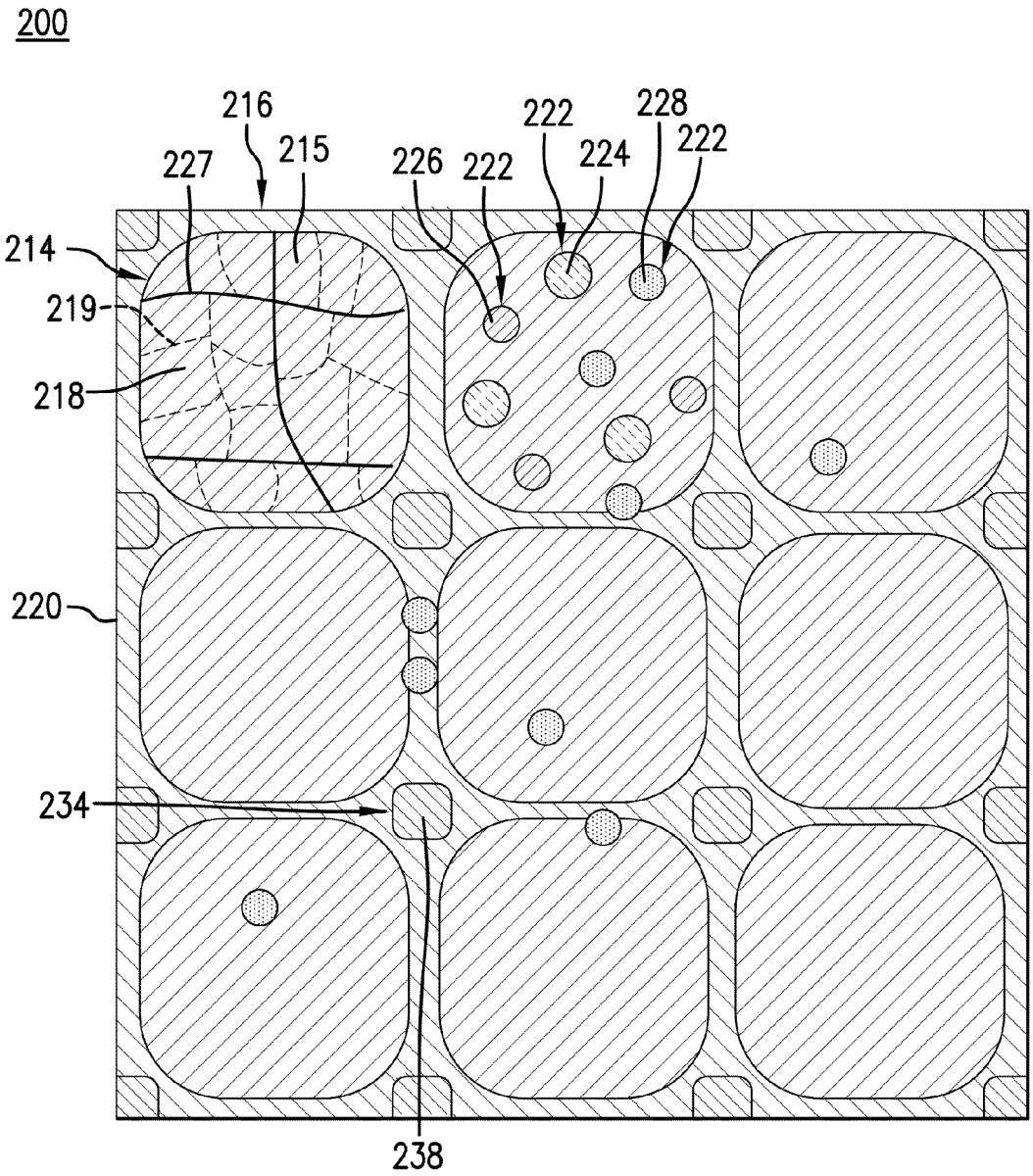
FIG. 6 depicts a cross sectional view of a disintegrable metal composite.

The metal composite/disintegrable material is, for example, a powder compact as shown in FIG. 6. According to FIG. 6, a metal composite 200 includes a cellular nanomatrix 216 comprising a nanomatrix material 220 and a metal matrix 214 (e.g., a plurality of dispersed particles) comprising a particle core material 218 dispersed in the cellular nanomatrix 216. The particle core material 218 comprises a nanostructured material. Such a metal composite having the cellular nanomatrix with metal matrix disposed therein is referred to as controlled electrolytic material.

Figure 8:
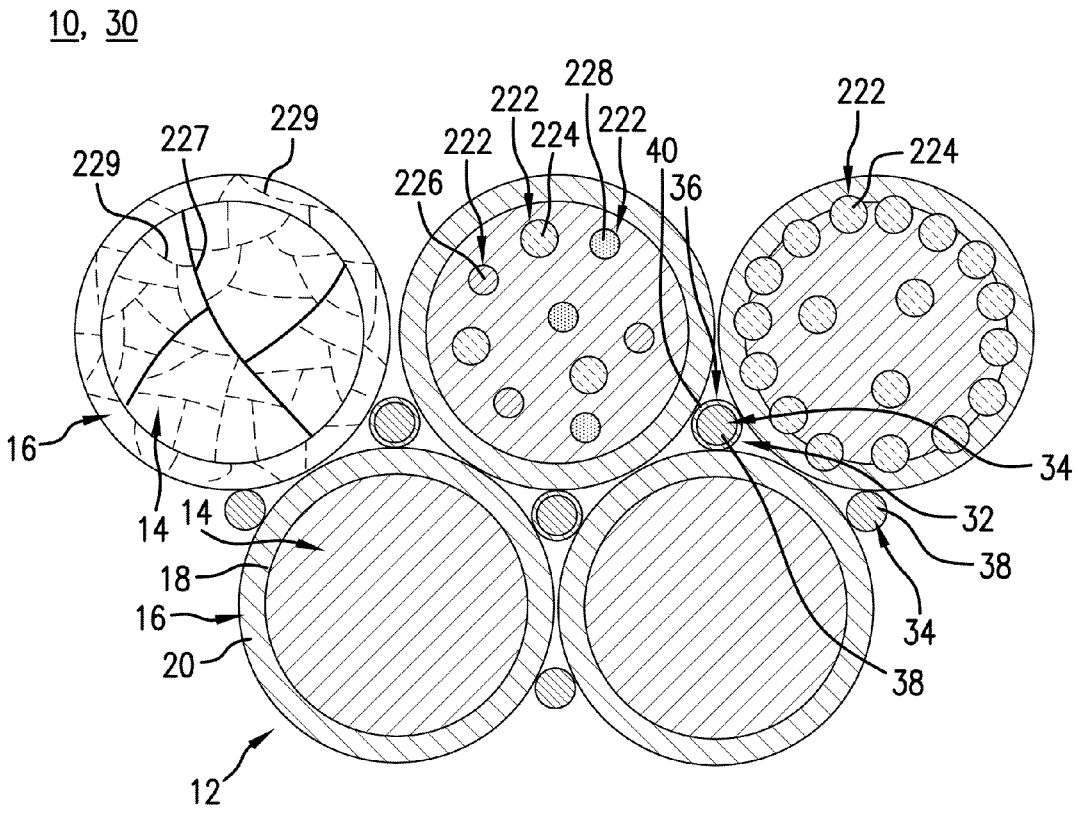
FIG. 8 depicts a cross sectional view of a composition used to make the disintegrable metal composite shown in FIG. 6.

With reference to FIGS. 6 and 8, metal matrix 214 can include any suitable metallic particle core material 218 that includes nanostructure as described herein. In an exemplary embodiment, the metal matrix 214 is formed from particle cores 14 (FIG. 8) and can include an element such as aluminum, iron, magnesium, manganese, zinc, or a combination thereof, as the nanostructured particle core material 218. More particularly, in an exemplary embodiment, the metal matrix 214 and particle core material 218 can include various Al or Mg alloys as the nanostructured particle core material 218, including various precipitation hardenable alloys Al or Mg alloys. In some embodiments, the particle core material 218 includes magnesium and aluminum where the aluminum is present in an amount of about 1 weight percent (wt %) to about 15 wt %, specifically about 1 wt % to about 10 wt %, and more specifically about 1 wt % to about 5 wt %, based on the weight of the metal matrix, the balance of the weight being magnesium.

In an additional embodiment, precipitation hardenable Al or Mg alloys are particularly useful because they can strengthen the metal matrix 214 through both nanostructuring and precipitation hardening through the incorporation of particle precipitates as described herein. The metal matrix 214 and particle core material 218 also can include a rare earth element, or a combination of rare earth elements. Exemplary rare earth elements include Sc, Y, La, Ce, Pr, Nd, or Er. A combination comprising at least one of the foregoing rare earth elements can be used. Where present, the rare earth element can be present in an amount of about 5 wt % or less, and specifically about 2 wt % or less, based on the weight of the metal composite.

The metal matrix 214 and particle core material 218 also can include a nanostructured material 215. In an exemplary embodiment, the nanostructured material 215 is a material having a grain size (e.g., a subgrain or crystallite size) that is less than about 200 nanometers (nm), specifically about 10 nm to about 200 nm, and more specifically an average grain size less than about 100 nm. The nanostructure of the metal matrix 214 can include high angle boundaries 227, which are usually used to define the grain size, or low angle boundaries 229 that may occur as substructure within a particular grain, which are sometimes used to define a crystallite size, or a combination thereof. It will be appreciated that the nanocellular matrix 216 and grain structure (nanostructured material 215 including grain boundaries 227 and 229) of the metal matrix 214 are distinct features of the metal composite 200. Particularly, nanocellular matrix 216 is not part of a crystalline or amorphous portion of the metal matrix 214.

The disintegration agent is included in the metal composite 200 to control the disintegration rate of the metal composite 200. The disintegration agent can be disposed in the metal matrix 214, the cellular nanomatrix 216, or a combination thereof. According to an embodiment, the disintegration agent includes a metal, fatty acid, ceramic particle, or a combination comprising at least one of the foregoing, the disintegration agent being disposed among the controlled electrolytic material to change the disintegration rate of the controlled electrolytic material. In one embodiment, the disintegration agent is disposed in the cellular nanomatrix external to the metal matrix. In a non-limiting embodiment, the disintegration agent increases the disintegration rate of the metal composite 200. In another embodiment, the disintegration agent decreases the disintegration rate of the metal composite 200. The disintegration agent can be a metal including cobalt, copper, iron, nickel, tungsten, zinc, or a combination comprising at least one of the foregoing. In a further embodiment, the disintegration agent is the fatty acid, e.g., fatty acids having 6 to 40 carbon atoms. Exemplary fatty acids include oleic acid, stearic acid, lauric acid, hyroxystearic acid, behenic acid, arachidonic acid, linoleic acid, linolenic acid, recinoleic acid, palmitic acid, montanic acid, or a combination comprising at least one of the foregoing. In yet another embodiment, the disintegration agent is ceramic particles such as boron nitride, tungsten carbide, tantalum carbide, titanium carbide, niobium carbide, zirconium carbide, boron carbide, hafnium carbide, silicon carbide, niobium boron carbide, aluminum nitride, titanium nitride, zirconium nitride, tantalum nitride, or a combination comprising at least one of the foregoing. Additionally, the ceramic particle can be one of the ceramic materials discussed below with regard to the strengthening agent. Such ceramic particles have a size of 5 μm or less, specifically 2 μm or less, and more specifically 1 μm or less. The disintegration agent can be present in an amount effective to cause disintegration of the metal composite 200 at a desired disintegration rate, specifically about 0.25 wt % to about 15 wt %, specifically about 0.25 wt % to about 10 wt %, specifically about 0.25 wt % to about 1 wt %, based on the weight of the metal composite.

In an exemplary embodiment, the cellular nanomatrix 216 includes aluminum, cobalt, copper, iron, magnesium, nickel, silicon, tungsten, zinc, an oxide thereof, a nitride thereof, a carbide thereof, an intermetallic compound thereof, a cermet thereof, or a combination comprising at least one of the foregoing. The metal matrix can be present in an amount from about 50 wt % to about 95 wt %, specifically about 60 wt % to about 95 wt %, and more specifically about 70 wt % to about 95 wt %, based on the weight of the seal. Further, the amount of the metal nanomatrix material is about 10 wt % to about 50 wt %, specifically about 20 wt % to about 50 wt %, and more specifically about 30 wt % to about 50 wt %, based on the weight of the seal.

In another embodiment, the metal composite includes a second particle. As illustrated generally in FIGS. 6 and 8, the metal composite 200 can be formed using a coated metallic powder 10 and an additional or second powder 30, i.e., both powders 10 and 30 can have substantially the same particulate structure without having identical chemical compounds. The use of an additional powder 30 provides a metal composite 200 that also includes a plurality of dispersed second particles 234, as described herein, that are dispersed within the cellular nanomatrix 216 and are also dispersed with respect to the metal matrix 214. Thus, the dispersed second particles 234 are derived from second powder particles 32 disposed in the powder 10, 30. In an exemplary embodiment, the dispersed second particles 234 include Ni, Fe, Cu, Co, W, Al, Zn, Mn, Si, an oxide thereof, nitride thereof, carbide thereof, intermetallic compound thereof, cermet thereof, or a combination comprising at least one of the foregoing.

Referring again to FIG. 6, the metal matrix 214 and particle core material 218 also can include an additive particle 222. The additive particle 222 provides a dispersion strengthening mechanism to the metal matrix 214 and provides an obstacle to, or serves to restrict, the movement of dislocations within individual particles of the metal matrix 214. Additionally, the additive particle 222 can be disposed in the cellular nanomatrix 216 to strengthen the metal composite 200. The additive particle 222 can have any suitable size and, in an exemplary embodiment, can have an average particle size of about 10 nm to about 1 micron, and specifically about 50 nm to about 200 nm. Here, size refers to the largest linear dimension of the additive particle. The additive particle 222 can include any suitable form of particle, including an embedded particle 224, a precipitate particle 226, or a dispersoid particle 228. Embedded particle 224 can include any suitable embedded particle, including various hard particles. The embedded particle can include various metals, carbon, metal oxide, metal nitride, metal carbide, intermetallic compound, cermet particle, or a combination thereof. In an exemplary embodiment, hard particles can include Ni, Fe, Cu, Co, W, Al, Zn, Mn, Si, an oxide thereof, nitride thereof, carbide thereof, intermetallic compound thereof, cermet thereof, or a combination comprising at least one of the foregoing. The additive particle can be present in an amount of about 0.5 wt % to about 25 wt %, specifically about 0.5 wt % to about 20 wt %, and more specifically about 0.5 wt % to about 10 wt %, based on the weight of the metal composite.

In metal composite 200, the metal matrix 214 dispersed throughout the cellular nanomatrix 216 can have an equiaxed structure in a substantially continuous cellular nanomatrix 216 or can be substantially elongated along an axis so that individual particles of the metal matrix 214 are oblately or prolately shaped, for example. In the case where the metal matrix 214 has substantially elongated particles, the metal matrix 214 and the cellular nanomatrix 216 may be continuous or discontinuous. The size of the particles that make up the metal matrix 214 can be from about 50 nm to about 800 μm, specifically about 500 nm to about 600 μm, and more specifically about 1 μm to about 500 μm. The particle size of can be monodisperse or polydisperse, and the particle size distribution can be unimodal or bimodal. Size here refers to the largest linear dimension of a particle.

Figure 7:
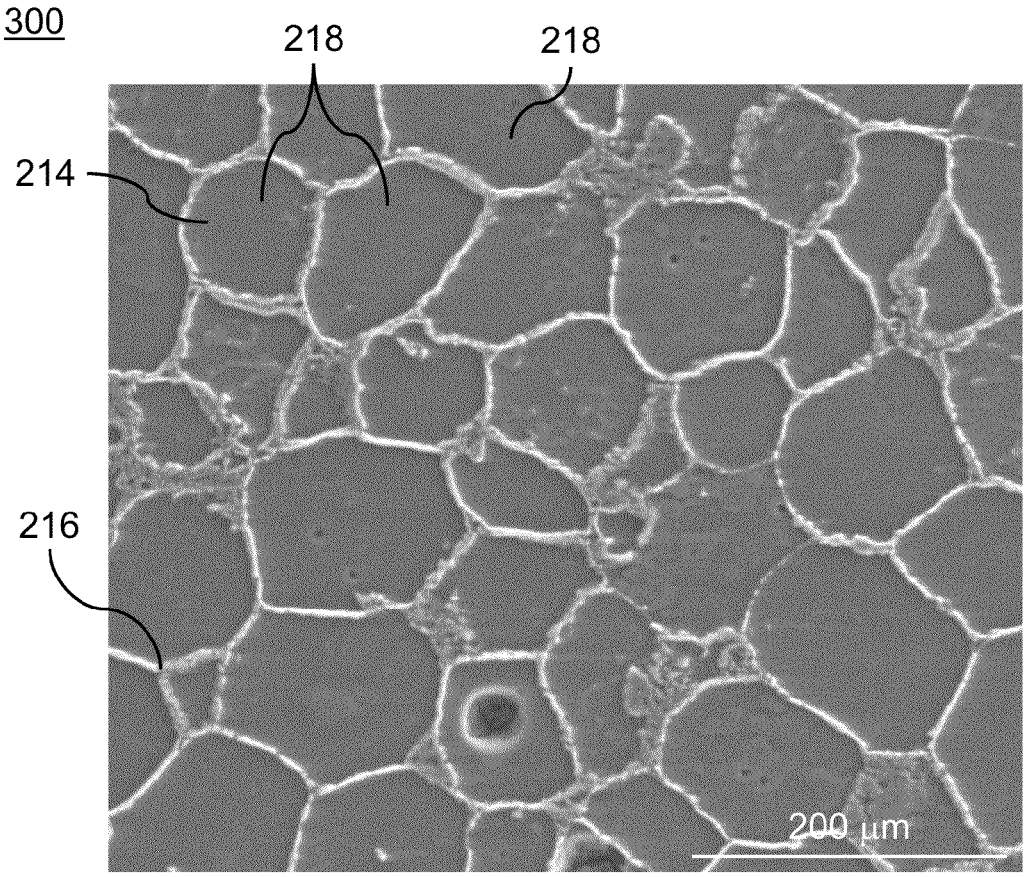
FIG. 7 is a photomicrograph of an exemplary embodiment of a disintegrable metal composite as disclosed herein.

Referring to FIG. 7 a photomicrograph of an exemplary embodiment of a metal composite is shown. The metal composite 300 has a metal matrix 214 that includes particles having a particle core material 218. Additionally, each particle of the metal matrix 214 is disposed in a cellular nanomatrix 216. Here, the cellular nanomatrix 216 is shown as a white network that substantially surrounds the component particles of the metal matrix 214.

According to an embodiment, the metal composite is formed from a combination of, for example, powder constituents. As illustrated in FIG. 8, a powder 10 includes powder particles 12 that have a particle core 14 with a core material 18 and metallic coating layer 16 with coating material 20. These powder constituents can be selected and configured for compaction and sintering to provide the metal composite 200 that is lightweight (i.e., having a relatively low density), high-strength, and selectably and controllably removable, e.g., by disintegration, from a borehole in response to a change in a borehole property, including being selectably and controllably disintegrable (e.g., by having a selectively tailorable disintegration rate curve) in an appropriate borehole fluid, including various borehole fluids as disclosed herein.

The nanostructure can be formed in the particle core 14 used to form metal matrix 214 by any suitable method, including a deformation-induced nanostructure such as can be provided by ball milling a powder to provide particle cores 14, and more particularly by cryomilling (e.g., ball milling in ball milling media at a cryogenic temperature or in a cryogenic fluid, such as liquid nitrogen) a powder to provide the particle cores 14 used to form the metal matrix 214. The particle cores 14 may be formed as a nanostructured material 215 by any suitable method, such as, for example, by milling or cryomilling of prealloyed powder particles of the materials described herein. The particle cores 14 may also be formed by mechanical alloying of pure metal powders of the desired amounts of the various alloy constituents. Mechanical alloying involves ball milling, including cryomilling, of these powder constituents to mechanically enfold and intermix the constituents and form particle cores 14. In addition to the creation of nanostructure as described above, ball milling, including cryomilling, can contribute to solid solution strengthening of the particle core 14 and core material 18, which in turn can contribute to solid solution strengthening of the metal matrix 214 and particle core material 218. The solid solution strengthening can result from the ability to mechanically intermix a higher concentration of interstitial or substitutional solute atoms in the solid solution than is possible in accordance with the particular alloy constituent phase equilibria, thereby providing an obstacle to, or serving to restrict, the movement of dislocations within the particle, which in turn provides a strengthening mechanism in the particle core 14 and the metal matrix 214. The particle core 14 can also be formed with a nanostructure (grain boundaries 227, 229) by methods including inert gas condensation, chemical vapor condensation, pulse electron deposition, plasma synthesis, crystallization of amorphous solids, electrodeposition, and severe plastic deformation, for example. The nanostructure also can include a high dislocation density, such as, for example, a dislocation density between about $10^{17}$ $m^{-2}$ and about $10^{18}$ $m^{-2}$, which can be two to three orders of magnitude higher than similar alloy materials deformed by traditional methods, such as cold rolling.

The substantially-continuous cellular nanomatrix 216 (see FIG. 7) and nanomatrix material 220 formed from metallic coating layers 16 by the compaction and sintering of the plurality of metallic coating layers 16 with the plurality of powder particles 12, such as by cold isostatic pressing (CIP), hot isostatic pressing (HIP), or dynamic forging. The chemical composition of nanomatrix material 220 may be different than that of coating material 20 due to diffusion effects associated with the sintering. The metal composite 200 also includes a plurality of particles that make up the metal matrix 214 that comprises the particle core material 218. The metal matrix 214 and particle core material 218 correspond to and are formed from the plurality of particle cores 14 and core material 18 of the plurality of powder particles 12 as the metallic coating layers 16 are sintered together to form the cellular nanomatrix 216. The chemical composition of particle core material 218 may also be different than that of core material 18 due to diffusion effects associated with sintering.

As used herein, the term cellular nanomatrix 216 does not connote the major constituent of the powder compact, but rather refers to the minority constituent or constituents, whether by weight or by volume. This is distinguished from most matrix composite materials where the matrix comprises the majority constituent by weight or volume. The use of the term substantially continuous, cellular nanomatrix is intended to describe the extensive, regular, continuous and interconnected nature of the distribution of nanomatrix material 220 within the metal composite 200. As used herein, "substantially continuous" describes the extension of the nanomatrix material 220 throughout the metal composite 200 such that it extends between and envelopes substantially all of the metal matrix 214. Substantially continuous is used to indicate that complete continuity and regular order of the cellular nanomatrix 220 around individual particles of the metal matrix 214 are not required. For example, defects in the coating layer 16 over particle core 14 on some powder particles 12 may cause bridging of the particle cores 14 during sintering of the metal composite 200, thereby causing localized discontinuities to result within the cellular nanomatrix 216, even though in the other portions of the powder compact the cellular nanomatrix 216 is substantially continuous and exhibits the structure described herein. In contrast, in the case of substantially elongated particles of the metal matrix 214 (i.e., non-equiaxed shapes), such as those formed by extrusion, "substantially discontinuous" is used to indicate that incomplete continuity and disruption (e.g., cracking or separation) of the nanomatrix around each particle of the metal matrix 214, such as may occur in a predetermined extrusion direction. As used herein, "cellular" is used to indicate that the nanomatrix defines a network of generally repeating, interconnected, compartments or cells of nanomatrix material 220 that encompass and also interconnect the metal matrix 214. As used herein, "nanomatrix" is used to describe the size or scale of the matrix, particularly the thickness of the matrix between adjacent particles of the metal matrix 214. The metallic coating layers that are sintered together to form the nanomatrix are themselves nanoscale thickness coating layers. Since the cellular nanomatrix 216 at most locations, other than the intersection of more than two particles of the metal matrix 214, generally comprises the interdiffusion and bonding of two coating layers 16 from adjacent powder particles 12 having nanoscale thicknesses, the cellular nanomatrix 216 formed also has a nanoscale thickness (e.g., approximately two times the coating layer thickness as described herein) and is thus described as a nanomatrix. Further, the use of the term metal matrix 214 does not connote the minor constituent of metal composite 200, but rather refers to the majority constituent or constituents, whether by weight or by volume. The use of the term metal matrix is intended to convey the discontinuous and discrete distribution of particle core material 218 within metal composite 200.

Embedded particle 224 can be embedded by any suitable method, including, for example, by ball milling or cryomilling hard particles together with the particle core material 18. A precipitate particle 226 can include any particle that can be precipitated within the metal matrix 214, including precipitate particles 226 consistent with the phase equilibria of constituents of the materials, particularly metal alloys, of interest and their relative amounts (e.g., a precipitation hardenable alloy), and including those that can be precipitated due to non-equilibrium conditions, such as may occur when an alloy constituent that has been forced into a solid solution of the alloy in an amount above its phase equilibrium limit, as is known to occur during mechanical alloying, is heated sufficiently to activate diffusion mechanisms that enable precipitation. Dispersoid particles 228 can include nanoscale particles or clusters of elements resulting from the manufacture of the particle cores 14, such as those associated with ball milling, including constituents of the milling media (e.g., balls) or the milling fluid (e.g., liquid nitrogen) or the surfaces of the particle cores 14 themselves (e.g., metallic oxides or nitrides). Dispersoid particles 228 can include an element such as, for example, Fe, Ni, Cr, Mn, N, O, C, H, and the like. The additive particles 222 can be disposed anywhere in conjunction with particle cores 14 and the metal matrix 214. In an exemplary embodiment, additive particles 222 can be disposed within or on the surface of metal matrix 214 as illustrated in FIG. 6. In another exemplary embodiment, a plurality of additive particles 222 are disposed on the surface of the metal matrix 214 and also can be disposed in the cellular nanomatrix 216 as illustrated in FIG. 6.

Similarly, dispersed second particles 234 may be formed from coated or uncoated second powder particles 32 such as by dispersing the second powder particles 32 with the powder particles 12. In an exemplary embodiment, coated second powder particles 32 may be coated with a coating layer 36 that is the same as coating layer 16 of powder particles 12, such that coating layers 36 also contribute to the nanomatrix 216. In another exemplary embodiment, the second powder particles 232 may be uncoated such that dispersed second particles 234 are embedded within nanomatrix 216. The powder 10 and additional powder 30 may be mixed to form a homogeneous dispersion of dispersed particles 214 and dispersed second particles 234 or to form a non-homogeneous dispersion of these particles. The dispersed second particles 234 may be formed from any suitable additional powder 30 that is different from powder 10, either due to a compositional difference in the particle core 34, or coating layer 36, or both of them, and may include any of the materials disclosed herein for use as second powder 30 that are different from the powder 10 that is selected to form powder compact 200.

In an embodiment, the metal composite optionally includes a strengthening agent. The strengthening agent increases the material strength of the metal composite. Exemplary strengthening agents include a ceramic, polymer, metal, nanoparticles, cermet, and the like. In particular, the strengthening agent can be silica, glass fiber, carbon fiber, carbon black, carbon nanotubes, borides, oxides, carbides, nitrides, silicides, borides, phosphides, sulfides, cobalt, nickel, iron, tungsten, molybdenum, tantalum, titanium, chromium, niobium, boron, zirconium, vanadium, silicon, palladium, hafnium, aluminum, copper, or a combination comprising at least one of the foregoing. According to an embodiment, a ceramic and metal is combined to form a cermet, e.g., tungsten carbide, cobalt nitride, and the like. Exemplary strengthening agents particularly include magnesia, mullite, thoria, beryllia, urania, spinels, zirconium oxide, bismuth oxide, aluminum oxide, magnesium oxide, silica, barium titanate, cordierite, boron nitride, tungsten carbide, tantalum carbide, titanium carbide, niobium carbide, zirconium carbide, boron carbide, hafnium carbide, silicon carbide, niobium boron carbide, aluminum nitride, titanium nitride, zirconium nitride, tantalum nitride, hafnium nitride, niobium nitride, boron nitride, silicon nitride, titanium boride, chromium boride, zirconium boride, tantalum boride, molybdenum boride, tungsten boride, cerium sulfide, titanium sulfide, magnesium sulfide, zirconium sulfide, or a combination comprising at least one of the foregoing. Non-limiting examples of strengthening agent polymers include polyurethanes, polyimides, polycarbonates, and the like.

In one embodiment, the strengthening agent is a particle with size of about 100 microns or less, specifically about 10 microns or less, and more specifically 500 nm or less. In another embodiment, a fibrous strengthening agent can be combined with a particulate strengthening agent. It is believed that incorporation of the strengthening agent can increase the strength and fracture toughness of the metal composite. Without wishing to be bound by theory, finer (i.e., smaller) sized particles can produce a stronger metal composite as compared with larger sized particles. Moreover, the shape of strengthening agent can vary and includes fiber, sphere, rod, tube, and the like. The strengthening agent can be present in an amount of 0.01 weight percent (wt %) to 20 wt %, specifically 0.01 wt % to 10 wt %, and more specifically 0.01 wt % to 5 wt %.

In a process for preparing a component of a disintegrable anchoring system (e.g., a seal, frustoconical member, sleeve, bottom sub, and the like) containing a metal composite, the process includes combining a metal matrix powder, disintegration agent, metal nanomatrix material, and optionally a strengthening agent to form a composition; compacting the composition to form a compacted composition; sintering the compacted composition; and pressing the sintered composition to form the component of the disintegrable system. The members of the composition can be mixed, milled, blended, and the like to form the powder 10 as shown in FIG. 8 for example. It should be appreciated that the metal nanomatrix material is a coating material disposed on the metal matrix powder that, when compacted and sintered, forms the cellular nanomatrix. A compact can be formed by pressing (i.e., compacting) the composition at a pressure to form a green compact. The green compact can be subsequently pressed under a pressure of about 15,000 psi to about 100,000 psi, specifically about 20,000 psi to about 80,000 psi, and more specifically about 30,000 psi to about 70,000 psi, at a temperature of about 250° C. to about 600° C., and specifically about 300° C. to about 450° C., to form the powder compact. Pressing to form the powder compact can include compression in a mold. The powder compact can be further machined to shape the powder compact to a useful shape. Alternatively, the powder compact can be pressed into the useful shape. Machining can include cutting, sawing, ablating, milling, facing, lathing, boring, and the like using, for example, a mill, table saw, lathe, router, electric discharge machine, and the like.

The metal matrix 200 can have any desired shape or size, including that of a cylindrical billet, bar, sheet, toroid, or other form that may be machined, formed or otherwise used to form useful articles of manufacture, including various wellbore tools and components. Pressing is used to form a component of the disintegrable anchoring system (e.g., seal, frustoconical member, sleeve, bottom sub, and the like) from the sintering and pressing processes used to form the metal composite 200 by deforming the powder particles 12, including particle cores 14 and coating layers 16, to provide the full density and desired macroscopic shape and size of the metal composite 200 as well as its microstructure. The morphology (e.g. equiaxed or substantially elongated) of the individual particles of the metal matrix 214 and cellular nanomatrix 216 of particle layers results from sintering and deformation of the powder particles 12 as they are compacted and interdiffuse and deform to fill the interparticle spaces of the metal matrix 214 (FIG. 6). The sintering temperatures and pressures can be selected to ensure that the density of the metal composite 200 achieves substantially full theoretical density.

The metal composite has beneficial properties for use in, for example a downhole environment. In an embodiment, a component of the disintegrable anchoring system made of the metal composite has an initial shape that can be run downhole and, in the case of the seal and sleeve, can be subsequently deformed under pressure. The metal composite is strong and ductile with a percent elongation of about 0.1% to about 75%, specifically about 0.1% to about 50%, and more specifically about 0.1% to about 25%, based on the original size of the component of the disintegrable anchoring system. The metal composite has a yield strength of about 15 kilopounds per square inch (ksi) to about 50 ksi, and specifically about 15 ksi to about 45 ksi. The compressive strength of the metal composite is from about 30 ksi to about 100 ksi, and specifically about 40 ksi to about 80 ksi. The components of the disintegrable anchoring system can have the same or different material properties, such as percent elongation, compressive strength, tensile strength, and the like.

Unlike elastomeric materials, the components of the disintegrable anchoring system herein that include the metal composite have a temperature rating up to about 1200° F., specifically up to about 1000° F., and more specifically about 800° F. The disintegrable anchoring system is temporary in that the system is selectively and tailorably disintegrable in response to contact with a downhole fluid or change in condition (e.g., pH, temperature, pressure, time, and the like). Moreover, the components of the disintegrable anchoring system can have the same or different disintegration rates or reactivities with the downhole fluid. Exemplary downhole fluids include brine, mineral acid, organic acid, or a combination comprising at least one of the foregoing. The brine can be, for example, seawater, produced water, completion brine, or a combination thereof. The properties of the brine can depend on the identity and components of the brine. Seawater, as an example, contains numerous constituents such as sulfate, bromine, and trace metals, beyond typical halide-containing salts. On the other hand, produced water can be water extracted from a production reservoir (e.g., hydrocarbon reservoir), produced from the ground. Produced water is also referred to as reservoir brine and often contains many components such as barium, strontium, and heavy metals. In addition to the naturally occurring brines (seawater and produced water), completion brine can be synthesized from fresh water by addition of various salts such as KCl, NaCl, $ZnCl_2$, $MgCl_2$, or $CaCl_2$ to increase the density of the brine, such as 10.6 pounds per gallon of $CaCl_2$ brine. Completion brines typically provide a hydrostatic pressure optimized to counter the reservoir pressures downhole. The above brines can be modified to include an additional salt. In an embodiment, the additional salt included in the brine is NaCl, KCl, NaBr, $MgCl_2$, $CaCl_2$, $CaBr_2$, $ZnBr_2$, $NH_4Cl$, sodium formate, cesium formate, and the like. The salt can be present in the brine in an amount from about 0.5 wt. % to about 50 wt. %, specifically about 1 wt. % to about 40 wt. %, and more specifically about 1 wt. % to about 25 wt. %, based on the weight of the composition.

In another embodiment, the downhole fluid is a mineral acid that can include hydrochloric acid, nitric acid, phosphoric acid, sulfuric acid, boric acid, hydrofluoric acid, hydrobromic acid, perchloric acid, or a combination comprising at least one of the foregoing. In yet another embodiment, the downhole fluid is an organic acid that can include a carboxylic acid, sulfonic acid, or a combination comprising at least one of the foregoing. Exemplary carboxylic acids include formic acid, acetic acid, chloroacetic acid, dichloroacetic acid, trichloroacetic acid, trifluoroacetic acid, proprionic acid, butyric acid, oxalic acid, benzoic acid, phthalic acid (including ortho-, meta- and para-isomers), and the like. Exemplary sulfonic acids include alkyl sulfonic acid or aryl sulfonic acid. Alkyl sulfonic acids include, e.g., methane sulfonic acid. Aryl sulfonic acids include, e.g., benzene sulfonic acid or toluene sulfonic acid. In one embodiment, the alkyl group may be branched or unbranched and may contain from one to about 20 carbon atoms and can be substituted or unsubstituted. The aryl group can be alkyl-substituted, i.e., may be an alkylaryl group, or may be attached to the sulfonic acid moiety via an alkylene group (i.e., an arylalkyl group). In an embodiment, the aryl group may be substituted with a heteroatom. The aryl group can have from about 3 carbon atoms to about 20 carbon atoms and include a polycyclic ring structure.

The disintegration rate (also referred to as dissolution rate) of the metal composite is about 1 milligram per square centimeter per hour ($mg/cm^2/hr$) to about 10,000 $mg/cm^2/hr$, specifically about 25 $mg/cm^2/hr$ to about 1000 $mg/cm^2/hr$, and more specifically about 50 $mg/cm^2/hr$ to about 500 $mg/cm^2/hr$. The disintegration rate is variable upon the composition and processing conditions used to form the metal composite herein.

Figure 9A:
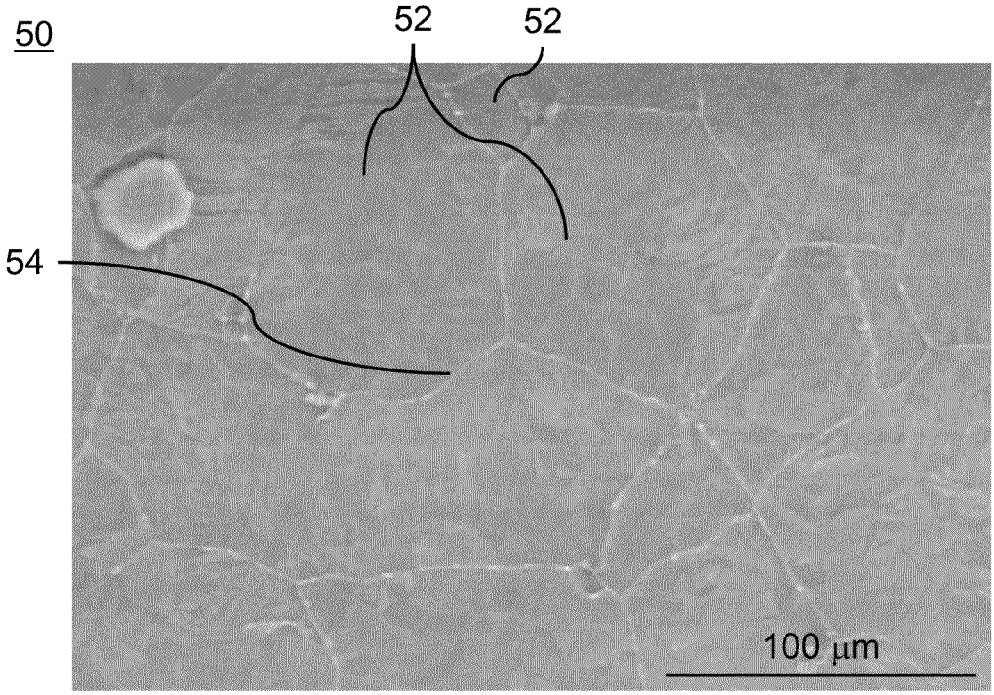
FIG. 9A is a photomicrograph of a pure metal without a cellular nanomatrix.
Figure 9B:
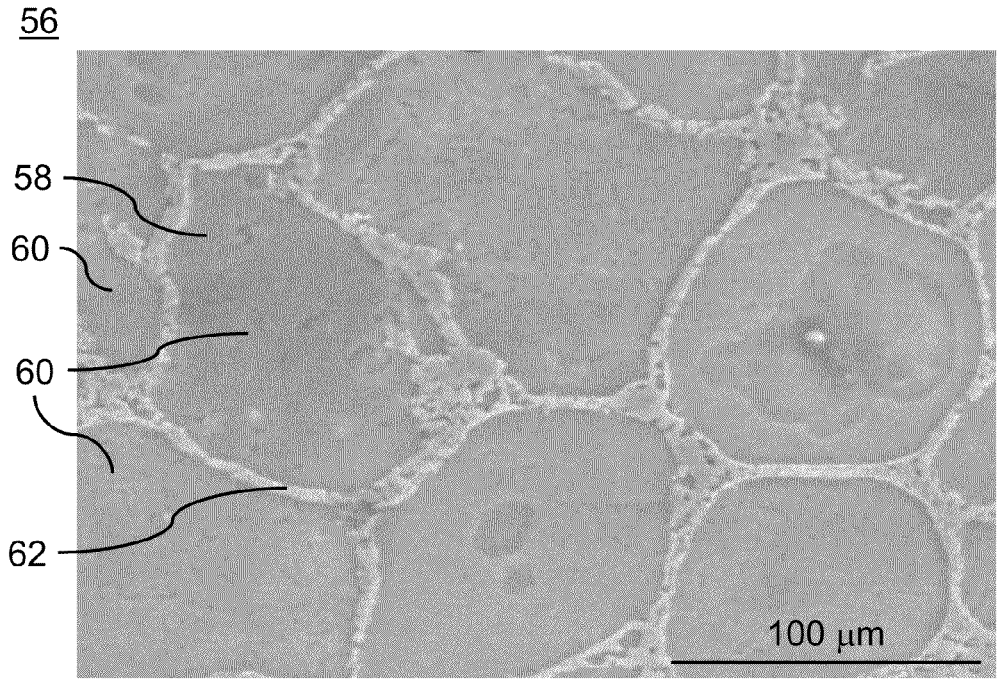
FIG. 9B is a photomicrograph of a disintegrable metal composite with a metal matrix and cellular nanomatrix.

Without wishing to be bound by theory, the unexpectedly high disintegration rate of the metal composite herein is due to the microstructure provided by the metal matrix and cellular nanomatrix. As discussed above, such microstructure is provided by using powder metallurgical processing (e.g., compaction and sintering) of coated powders, wherein the coating produces the nanocellular matrix and the powder particles produce the particle core material of the metal matrix. It is believed that the intimate proximity of the cellular nanomatrix to the particle core material of the metal matrix in the metal composite produces galvanic sites for rapid and tailorable disintegration of the metal matrix. Such electrolytic sites are missing in single metals and alloys that lack a cellular nanomatrix. For illustration, FIG. 9A shows a compact 50 formed from magnesium powder. Although the compact 50 exhibits particles 52 surrounded by particle boundaries 54, the particle boundaries constitute physical boundaries between substantially identical material (particles 52). However, FIG. 9B shows an exemplary embodiment of a composite metal 56 (a powder compact) that includes a metal matrix 58 having particle core material 60 disposed in a cellular nanomatrix 62. The composite metal 56 was formed from aluminum oxide coated magnesium particles where, under powder metallurgical processing, the aluminum oxide coating produces the cellular nanomatrix 62, and the magnesium produces the metal matrix 58 having particle core material 60 (of magnesium). Cellular nanomatrix 62 is not just a physical boundary as the particle boundary 54 in FIG. 9A but is also a chemical boundary interposed between neighboring particle core materials 60 of the metal matrix 58. Whereas the particles 52 and particle boundary 54 in compact 50 (FIG. 9A) do not have galvanic sites, metal matrix 58 having particle core material 60 establish a plurality of galvanic sites in conjunction with the cellular nanomatrix 62. The reactivity of the galvanic sites depend on the compounds used in the metal matrix 58 and the cellular nanomatrix 62 as is an outcome of the processing conditions used to the metal matrix and cellular nanomatrix microstructure of the metal composite.

Not only does the microstructure of the metal composite govern the disintegration rate behavior of the metal composite but also affects the strength and ductility of the metal composite. As a consequence, the metal composites herein also have a selectively tailorable material strength yield (and other material properties), in which the material strength yield varies due to the processing conditions and the materials used to produce the metal composite. That is, the microstructural morphology of the substantially continuous, cellular nanomatrix, which can be selected to provide a strengthening phase material, with the metal matrix (having particle core material), provides the metal composites herein with enhanced mechanical properties, including compressive strength and sheer strength, since the resulting morphology of the cellular nanomatrix/metal matrix can be manipulated to provide strengthening through the processes that are akin to traditional strengthening mechanisms, such as grain size reduction, solution hardening through the use of impurity atoms, precipitation or age hardening and strain/work hardening mechanisms. The cellular nanomatrix/metal matrix structure tends to limit dislocation movement by virtue of the numerous particle nanomatrix interfaces, as well as interfaces between discrete layers within the cellular nanomatrix material as described herein. Because the above-discussed materials have high-strength characteristics, the core material and coating material may be selected to utilize low density materials or other low density materials, such as low-density metals, ceramics, glasses or carbon, that otherwise would not provide the necessary strength characteristics for use in the desired applications, e.g., centralization, stabilization, deformation, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A deformation system, comprising:

a deformable member having a first set of dimensions; and a tool within the deformable member having at least a portion thereof operatively arranged to impart a deforming force to the deformable member in order to deform the member from the first set of dimensions at which the deformable member is positionable with respect to a structure to a second set of dimensions at which the deformable member engages with the structure, wherein at least the portion of the tool that imparts the deforming force at least partially comprises a disintegrable material responsive to a selected fluid.

2. The deformation system of claim 1, wherein the disintegrable material comprises a plurality of metallic powder particles, each powder particle including a particle core, each particle core comprising a core material and a metallic coating layer disposed on the particle core and comprising a metallic coating material.

3. The deformation system of claim 1, wherein the disintegrable material comprises a cellular nanomatrix comprising:

a metallic nanomatrix material;

a metal matrix disposed in the cellular nanomatrix; and a disintegration agent.

4. The deformation system of claim 1, wherein the tool comprises at least a first material having a first rate of disintegration and a second material having a second rate of disintegration, the first and second rates of disintegration differing from each other.

5. The deformation system of claim 4, wherein the first material is arranged as a shell and the second material is arranged as a core surrounded by the shell.

6. The deformation system of claim 4, wherein the first rate of disintegration is slower than that of the second rate of disintegration.

7. The deformation system of claim 1, further comprising a ratcheting or locking feature between the tool and the member for maintaining the tool and the member in an engaged state after actuation of the tool.

8. The deformation system of claim 1, wherein the tool is actuated by hydraulic pressure.

9. The deformation system of claim 1, wherein the selected fluid is water, brine, oil, or a combination including at least one of the foregoing.

10. The deformation system of claim 1, wherein the deformable member is at least temporarily secured to a support member for enabling relative movement between the tool and the deformable member during deformation.

11. The deformation system of claim 1, wherein the deformable member is at least in part disintegrable.

12. The deformation system of claim 1, wherein the deformable member is made from a disintegrable material.

13. A deformation system, comprising:

a deformable member having a first set of dimensions; and a tool having at least a portion thereof operatively arranged to impart a deforming force to the deformable member in order to deform the member from the first set of dimensions at which the deformable member is positionable with respect to a structure to a second set of dimensions at which the deformable member engages with the structure, wherein at least the portion of the tool that imparts the deforming force at least partially comprises a disintegrable material responsive to a selected fluid, and wherein the deformable member is arranged to seal against the structure after deformation of the member.

14. The deformation system of claim 13, wherein the deformable member includes a seal element.

15. The deformation system of claim 14, wherein the structure is a tubular, a casing, or a tubing radially outwardly positioned with respect to the tool and the deformable member.

16. The deformation system of claim 15, wherein the tool is a plug, and the plug and the seal element are operatively engagable together to fluidly isolate areas in the structure on opposite sides of the tool.

17. The deformation system of claim 13, wherein the deformable member includes a gripping element for enabling the deformable member to grip the structure.

18. The deformation system of claim 17, wherein the gripping element also seals the deformable member against the structure.

19. A method of operating a deformation system, comprising:

actuating a tool having at least a portion thereof within a deformable member and operatively arranged to impart a deforming force to the deformable member in order to deform the member from a first set of dimensions at which the deformable member is positionable with respect to a structure to a second set of dimensions at which the deformable member engages with the structure, wherein at least the portion of the tool that imparts the deforming force at least partially comprises a disintegrable material;

deforming the deformable member with the tool; and disintegrating at least the portion of the tool upon exposure to a selected fluid.

20. The method of claim 19, further comprising disintegrating the deformable member.

21. A method of operating a deformation system, comprising:

actuating a tool having at least a portion thereof operatively arranged to impart a deforming force to the deformable member in order to deform the member from the first set of dimensions at which the deformable member is positionable with respect to a structure to a second set of dimensions at which the deformable member engages with the structure, wherein at least the portion of the tool that imparts the deforming force at least partially comprises a disintegrable material;

deforming the deformable member with the tool, wherein deforming the deformable member includes sealing the deformable member against a radially adjacent structure; and disintegrating at least the portion of the tool upon exposure to a selected fluid.

22. The method of claim 21, wherein the tool is a plug operatively engagable with the member for together isolating zones in the structure on opposite sides of the tool.

23. The method of claim 22, further comprising fracturing a selected one of the zones while the zones are isolated from each other.

* * * * *